United States Patent [19]

Holtschmidt

[11] 4,403,498

[45] Sep. 13, 1983

[54] PRESS

[75] Inventor: Arthur Holtschmidt, Augsburg, Fed. Rep. of Germany

[73] Assignee: Karl Mengele & Söhne Maschinenfabrik und Eisengiesserei GmbH & Co., Gunzburg, Fed. Rep. of Germany

[21] Appl. No.: 283,297

[22] Filed: Jul. 14, 1981

[30] Foreign Application Priority Data

Jul. 19, 1980 [DE] Fed. Rep. of Germany ..... 3027495

[51] Int. Cl.[3] ..... B21D 5/02

[52] U.S. Cl. ..... 72/455; 72/389; 100/214

[58] Field of Search ..... 72/455, 389, 453.01, 72/453.18; 100/231, 214, 269

[56] References Cited

U.S. PATENT DOCUMENTS

| | | | |
|---|---|---|---|
| 2,296,051 | 9/1942 | Pocock | 100/231 |
| 2,580,078 | 12/1951 | Denison | 100/231 |
| 3,247,783 | 4/1966 | Hammon | 100/231 |
| 3,561,252 | 2/1971 | Norton | 72/455 |

FOREIGN PATENT DOCUMENTS

| | | | |
|---|---|---|---|
| 1403553 | 5/1965 | France | 72/455 |

*Primary Examiner*—Gene Crosby

*Attorney, Agent, or Firm*—Toren, McGeady and Stanger

[57] ABSTRACT

A press having a tamping tool with a hydraulic drive includes a top clamping bar and a structure which clears a working space accessible from three sides. The structure is asymmetrically stressed during operation. The press includes a table with lower tools carried on the table. At least two lower crossheads are connected and are located at the rear of the table. Upright columns are mounted on the lower crossheads and limit the working space from the rear. Upper crossheads are connected with the upright columns. The upright columns are constructed as tension-compression elements and may include tension rods. The table along with the upper and lower crossheads and possibly the upright columns can be cast of concrete.

5 Claims, 4 Drawing Figures

PRESS

The invention relates to a press with a hydraulic drive of the tamping tool which consists, for instance, of a top clamping bar, and with a structure which clears a working space that is accessible from three sides. This structure is asymmetrically stressed during the working operation.

Working spaces which are accessible from three sides are usually achieved in presses with a C-structure. But it is disadvantageous that the stress results between the open ends so that structures of this type are always asymmetrically stressed and are therefore subject to considerable bending stress.

Therefore, the bodies of the C-structure presses must usually consist of one piece whereby upward limits are set with regard to their size.

Straight-sided presses, however, do not have these disadvantages because they consist of a top portion, a bottom portion and two or four side portions which are connected by means of tension rods and which are under such strong initial tension that even at the maximum allowable press force this initial tension is still present. Subdivision of the press body permits a more rational utilization of materials than in C-presses and it is also possible to connect cast parts and welded parts with one another wherein already by means of drawn in rods the cast parts themselves have again been prestressed.

Since in straight-sided presses the working space is located in the center, for instance, only limited trimming work can be performed here. In addition, hydraulic presses of this type have less rigidity as well as less resistance against asymmetrical stress and use and for this reason they are usually used only for processing of parts which are as symmetrical as possible.

It is the task of the invention to combine the advantages of the accessibility from three sides and the better material utilization by sectioning and by preventing large bending stresses of compared types of presses while avoiding their disadvantages to a great extent.

The task of the invention is solved by combining the following features, some of which are known per se:

(a) At the rear of a table which carries lower tools at least two lower crossheads are connected on which the upright columns which limit the working space at the rear are arranged, and at which are arranged hydraulic working cylinders with the tamping tool and its guidances either directly or at upper crossheads connected with the upright columns;

(b) At the side of the upright columns opposite the working space the lower crossheads are connected with a girder at the upright columns or at the upper crossheads by means of pressure columns;

(c) The pressure columns are connected with hydraulic expanding cylinders which are connected in parallel with the working cylinders in such a way that they apply a pressure on the lower crossheads and the upper crossheads or the upper girders which compensates the load of the press;

(d) The upright columns are constructed as tension-compression elements, optionally with tension rods.

Since herewith the same forces always occur which act, for instance, at the same distances in front of and behind the upright columns in the structure, the structure is not subjected to an eccentric load, i.e. no bending moments occur.

The tamping tool of the press always remains parallel to the table while working with the table in the transverse direction independent of any stretching of the structure and does not stretch as do C-structures.

The press according to the invention is easily accessible as usually only C-structures are and all conceivable pressing work can be performed with this press. In addition to the versatility of use, now also presses can be manufactured in oversized dimensions and particularly with less expensive materials which can only be used in compression. According to the invention, for instance, most parts of the press body may consist of prestressed concrete. Therefore, it is now also possible to manufacture presses in unusual and, therefore, not transportable dimensions at the location where they are used, by means of concrete casting procedure. This construction and other details of the invention are described in the subclaims.

The invention is elucidated and described in the drawing with the aid of an exemplified embodiment. In the drawing.

Figure 1:
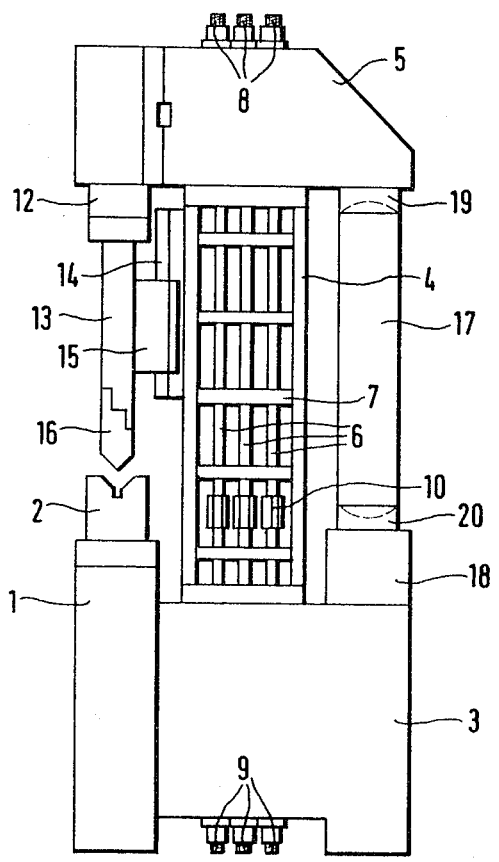
FIG. 1 shows a side view of the press according to the invention.
Figure 2:
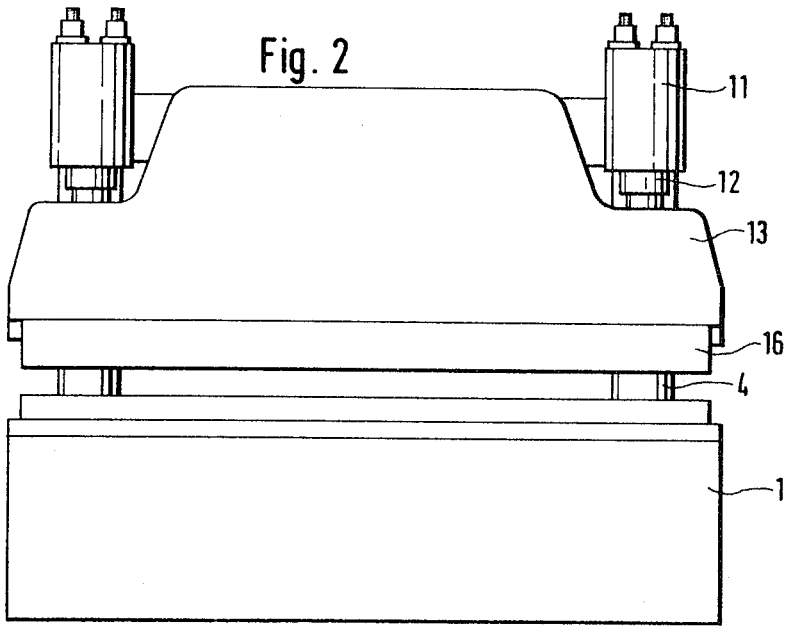
FIG. 2 shows a front view of the press according to the invention.

In the drawing the table is identified with 1, the lower tool 2 is arranged at the table with the lower crossheads 3 which complete the table to form a base, 4 identifies the upright columns according to the invention which carry the upper crosshead 5 that is located opposite the lower crossheads 3. The crossheads 3 and 5 as well as the connecting upright columns 4 are pressed together by tension rods 6 which are held in the upright columns 4 by means of guide ribs 7, i.e. by means of the tightening screws 8 and 9. Tension rod connections in the form of double nuts 10 facilitate assembly. At the front of the crossheads, working cylinders 11 are arranged and a top clamping bar 13 which represents the tamping tool is arranged at the piston 12 of the working cylinder. The top clamping bar 13 is slidably guided with carriages 15 in the guidances 14 at the upright columns 4. An upper tool attached at the top clamping bar 13 is identified with 16. At the side of the upright columns 4 which lies opposite this press device, pressure columns 17 according to the invention are assigned to each working cylinder 11 and these pressure columns are stressed in the same pressure-time response by means of expanding cylinders 18 which are connected in parallel with the working cylinders 11.

The pressure columns 17 are provided at the top and the bottom with spherical joint sections 19 and 20 which compensate for bending moments.

Consequently the axial centric loading of the prestressed upright columns 4 is ensured independently of the course of the work forces. The upright columns 4 therefore can be built as a rolled profile, a welded profile or a cast hollow profile. Only the tension rods 6 must be made of a high grade material.

The tension rods 6 are prestressed to such an extent that even at maximum press load the parts clamped together with the tension rods are never completely free of load.

Figure 4:
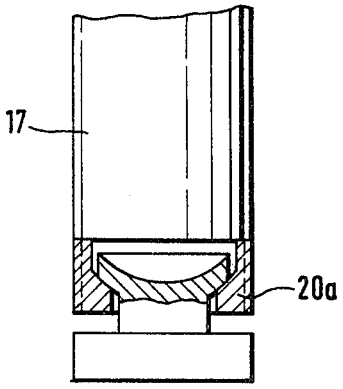
FIG. 4 shows a detail of the press according to the invention in accordance with FIG. 3.

If also bending of the upright columns 4 is to be compensated by means of the weight of the top clamping bar 13, then the working cylinders 11 and also the expanding cylinders 18 are constructed to be double-acting and the joints 19 and 20 are in this case—as shown in FIG. 4—also designed to take up tensile forces. The double action of the working cylinders 11 can also be provided in case higher requirements are made concerning the positioning accuracy of the upper tools 16 in relation to the lower tools 2.

Of course the prestressed upright columns and possibly also the pressure columns can also be made of concrete or concrete with reinforcements.

The guide ribs 7 serve for stiffening of the upright column 6. This increases the buckling strength of the prestressed upright column 6. Also conceivable are clip guidances of the tension rods 6 which permit an assembly of the rods from the side. The power introduction plate 21*b* may in the embodiment be provided with a recess 22 in order to prevent lifting of the upper or lower crosshead 3/5 due to its bending by the prestressed upright columns 4.

The table 1 including the lower crosshead 3 is manufactured of prestressed concrete, that is, the table and the lower crosshead are formed as a unit. Similarly the upper crosshead 5 can be cast of concrete together with the upright columns 4.

Figure 3:
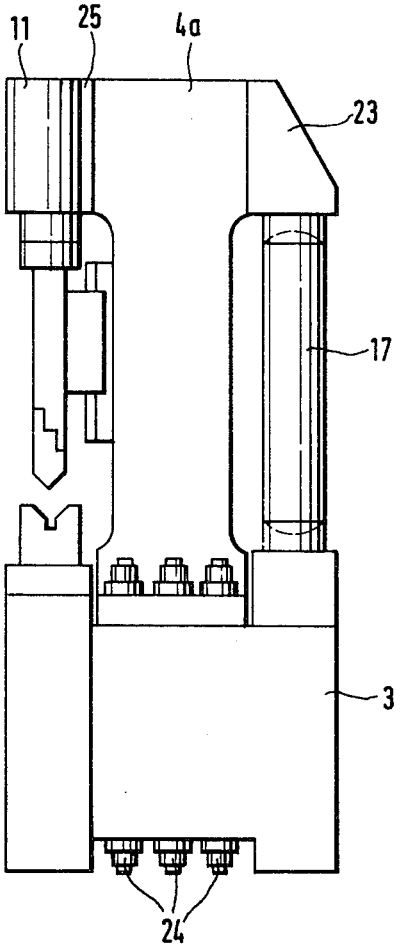
FIG. 3 shows a modification of the press according to the invention.

In the embodiment according to FIG. 3, the upright column 4*a* is constructed at the same time as a tension element and is attached with spacer bolts 24 at the lower crossheads 3. At the top at the upright columns 4*a* the pressure columns 17 are connected by means of girders 23 with the lower crossheads 3. However, the working cylinders 11 are attached at the opposite girders 25.

LIST OF REFERENCE NUMBERS

1. Table
2. Lower tool
3. Crossheads, lower
4. Upright columns
5. Crossheads, upper
6. Tension rods
7. Guide ribs
8. Tightening screws
9. Tightening screws
10. Double nuts
11. Working cylinder
12. Piston
13. Top clamping bar (tamping tool)
14. Guidances
15. Carriage
16. Upper Tool
17. Pressure columns
18. Expanding cylinder
19. Joint
20. Joint
21. Power introduction plate
22. Recess
23. Girder
24. Spacer bolt
25. Girder
Arrow A Working space

I claim:

1. A press comprising a tamping tool with hydraulic drive for the tamping tool, a table, and a multiple part structure comprising a lower crosshead arrangement connected to said table, an upper crosshead arrangement spaced above said lower crosshead arrangement, a top clamping bar carried by said upper cross head arrangement, and a center part extending between and interconnecting said lower crosshead arrangement and said upper crosshead arrangement, said multiple part structure clears a working space in the press that is accessible from three sides, said multiple part structure being stressed during the working operation, and comprising:

(a) said center part comprises upright columns,
(b) said table and said lower crosshead arrangement are formed as a unit of prestressed concrete, and
(c) said multiple part structure has a front side and a rear side with said upright columns spaced between said front and rear sides, and pressure columns including hydraulic expanding cylinders located on the rear side of said upright columns and extending between said lower crosshead arrangement and said upper crosshead arrangement.

2. A press, as set forth in claim 1, wherein said upper crosshead arrangement and said upright columns are cast as a unit of concrete.

3. A press, as set forth in claim 1, wherein prestressed tension rods connect said upright columns with said lower crosshead arrangement and said upper crosshead arrangement.

4. A press, as set forth in claim 1, wherein each said pressure column has a spherical joint section at its upper and lower ends.

5. A press, as set forth in claim 1, wherein a joint is provided between said pressure columns and said upper crosshead arrangement and said joint is rotatable about an axis extending parallel to the plane of movement of said tamping tool of said press.

* * * * *